US005822931A

United States Patent [19]

Galowitz et al.

[11] Patent Number: 5,822,931

[45] Date of Patent: Oct. 20, 1998

[54] METHOD AND APPARATUS FOR EXTENDING A FRAME

[75] Inventors: Dennis A. Galowitz, Stillwater; Todd W. Bruchu, Lake Elmo, both of Minn.

[73] Assignee: Andersen Corporation, Bayport, Minn.

[21] Appl. No.: 817,425

[22] PCT Filed: Oct. 19, 1995

[86] PCT No.: PCT/US95/13255

§ 371 Date: Apr. 17, 1997

§ 102(e) Date: Apr. 17, 1997

[87] PCT Pub. No.: WO96/12861

PCT Pub. Date: May 2, 1996

[51] Int. Cl.[6] ..... E06B 3/00

[52] U.S. Cl. ..... 52/204.5; 52/204.58; 52/204.57; 52/762

[58] Field of Search ..... 52/204.5, 204.58, 52/204.593, 204.54, 204.57, 762, 763, 204.51, 727; 49/DIG. 4

[56] References Cited

U.S. PATENT DOCUMENTS 4,328,644 5/1982 Scott et al. ..... 52/727 X
5,555,684 9/1996 Galowitz et al. ..... 52/204.5

*Primary Examiner*—Carl D. Friedman
*Assistant Examiner*—W. Glenn Edwards
*Attorney, Agent, or Firm*—Merchant, Gould, Smith Edell, Welter & Schmidt, P.A.

[57] ABSTRACT

The present invention provides an assembly for extending the effective depth of a frame (510) secured within an opening having a depth greater than that of the frame (501–504) itself. A channel (515) is associated with each segment of the frame (501–504) and opens in the direction in which added frame depth is desired. Each channel (515) has a similar, half-dovetail profile (560), and a frame extending member (520) is associated with each channel. Each frame extending member (520) has a profile that includes a first portion (501) which is rotatable into engagement with a respective channel, and a second portion (650*a*) which extends in the desired direction when the first portion (501) is retained within the channel (515).

19 Claims, 10 Drawing Sheets

METHOD AND APPARATUS FOR EXTENDING A FRAME

FIELD OF THE INVENTION

The present invention relates to fastening methods and apparatus and more particularly, to a method and apparatus suitable for extending the depth of a frame.

BACKGROUND OF THE INVENTION

A standard depth for window assemblies is approximately three and one-half inches. This relatively standard depth lends itself well to installation of window assemblies in buildings having wall supporting frames built with two by four studs, because any openings for windows are framed by studs that are three and one-half inches deep. On the other hand, this relatively standard depth does not lend itself particularly well to installation in buildings having wall supporting frames built with two by six studs, because any openings for windows are framed by studs that are five and one-half inches deep. Nonetheless, economies of scale often discourage the production of five and one-half inch deep window assemblies, perhaps because the bulk of demand for windows to date has been in connection with two by four construction. Thus, a need exists to facilitate installation of three and one-half inch deep window assemblies into openings framed by five and one-half inch studs or jambs in a manner that is attractive and cost effective.

SUMMARY OF THE INVENTION

The present invention provides an assembly for extending the effective depth of a frame to be secured within an opening having a depth greater than that of the frame itself. In this context, "depth" is measured in a direction perpendicular from a plane defined by the frame or matter retained within the frame. A channel is associated with each segment of the frame and opens in the direction in which added frame depth is desired. Each channel has a similar, half-dovetail profile. A frame extending member is associated with each channel. Each frame extending member has a profile that includes a first portion which is rotatable into engagement with a respective channel, and a second portion which extends in the desired direction when the first portion is retained within the channel.

As applied to a rectangular window frame, the present invention provides a channel extending along substantially the entire length of each of two vertical frame segments, and a channel extending along each of two horizontal frame segments and between the two vertical channels and their associated structure. The first and second portions on a pair of vertical extension members extend substantially the entire length of their corresponding vertical channels. The first portions on a pair of horizontal extension members extend the distance between the vertical channels and their associated structure, and the second portions extend the distance between the vertical extension members.

After the vertical extension members are manipulated into engagement with their respective channels, the horizontal extension members are then manipulated into engagement with their respective channels. The engaged horizontal extension members extend between the vertical extension members and thereby prevent the vertical extension members from rotating out of engagement with their respective channels. In one embodiment, the ends of the horizontal members snap into place beyond shoulders formed near the ends of the vertical members to secure the extension members relative to the frame and one another. In another embodiment, fasteners extend through the vertical extension members and into the horizontal extension members to similarly hold the horizontal extension members in place. In either case, the present invention facilitates construction of a sturdy and attractive frame extending structure in a manner that requires few fasteners and consumes little time.

The channel defining structure may be clipped or integrally joined to the frame members to eliminate the need to drive any fasteners into the frame. The elimination of such fasteners is particularly advantageous in cases where the frame is made of plastic or some other material not necessarily conducive to receiving screws or nails. These advantages and others will become apparent upon a more detailed description of the preferred embodiment.

BRIEF DESCRIPTION OF THE DRAWING

With reference to the FIGS. of the Drawing, wherein like numerals represent like parts and assemblies throughout the several views.

DETAILED DESCRIPTION OF A PREFERRED EMBODIMENT

Figure 1:
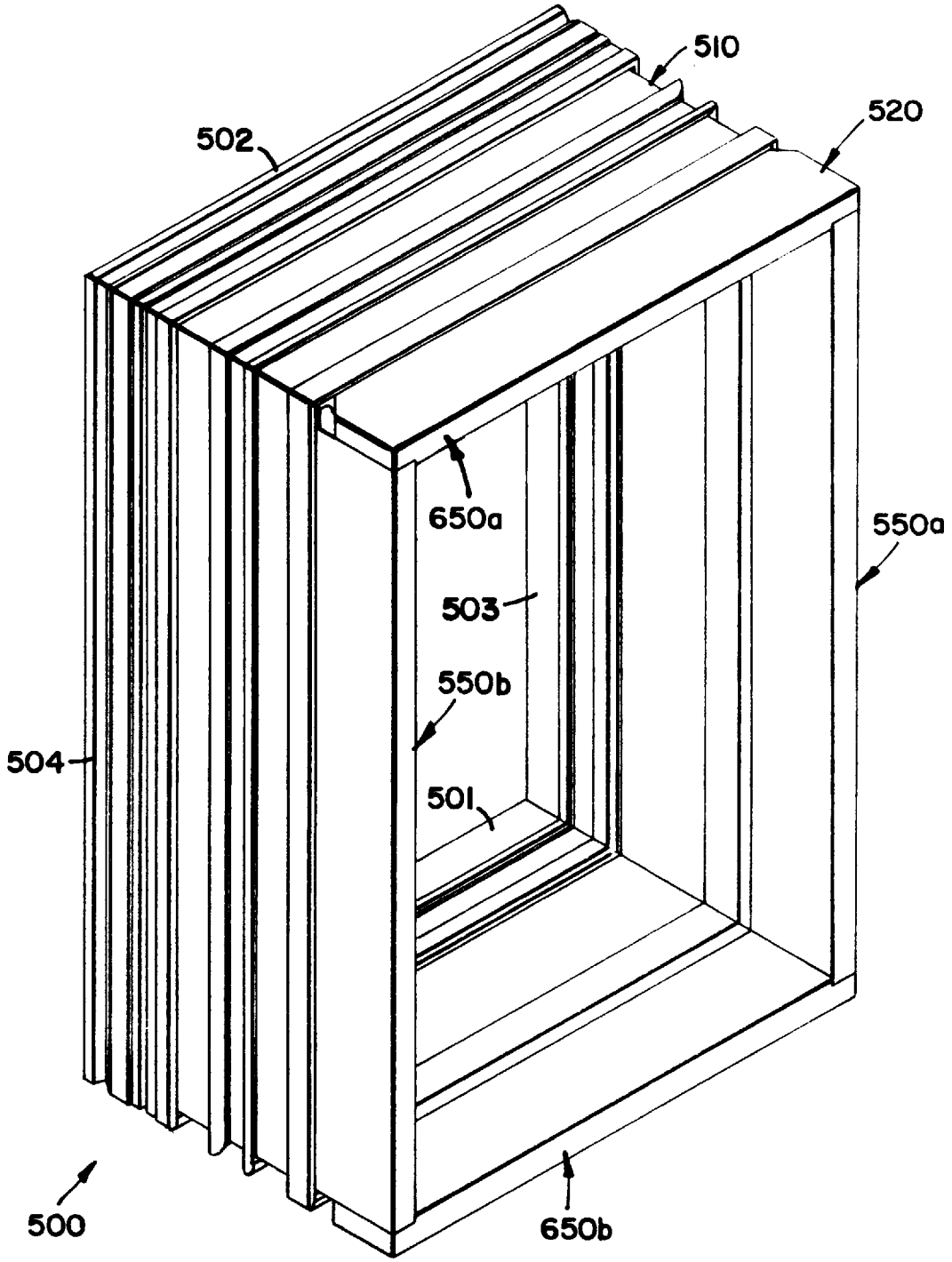
FIG. 1 is an isometric view of a preferred embodiment window and window frame jamb extension constructed according to the principles of the present invention.
Figure 2:
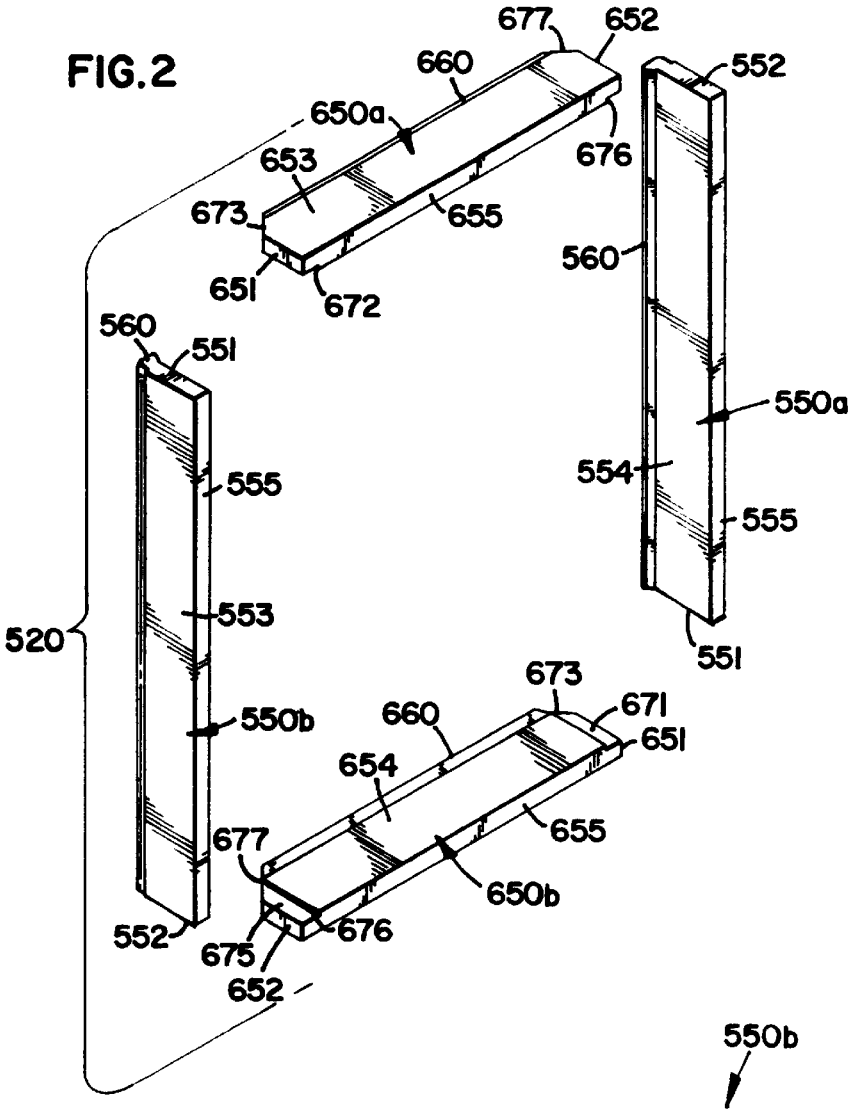
FIG. 2 is an exploded perspective view of the window frame jamb extension of FIG. 1.

A preferred embodiment window and window frame extension constructed according to the principles of the present invention are collectively designated as 500 in FIG. 1.

Window Frame

The window frame 510 includes four window frame members 501–504 that are secured end to end at right angles relative to one another to form the window frame 510. Each of the four window frame members 501–504 is an extrusion of a composite material including wood and polyvinyl chloride, and the cross-sectional profile shown in FIG. 8. The window frame members 501–504 are welded to one another by applying heat until a bond forms between some of the polyvinyl chloride in each of two adjacent members.

The specifics of the window frame members 501–504 are shown and described in greater detail (with reference to part number 600) in the more recently filed parent application, U.S. application Ser. No. 08/490,400, which is incorporated herein by reference to same. Generally speaking, the frame members 501–504 are suitable for receiving a pocket replacement window and converting same for use in window-in/window out replacement or new construction installation. The liners of the pocket replacement window simply snap into place on respective frame members 501–504.

Figure 5:
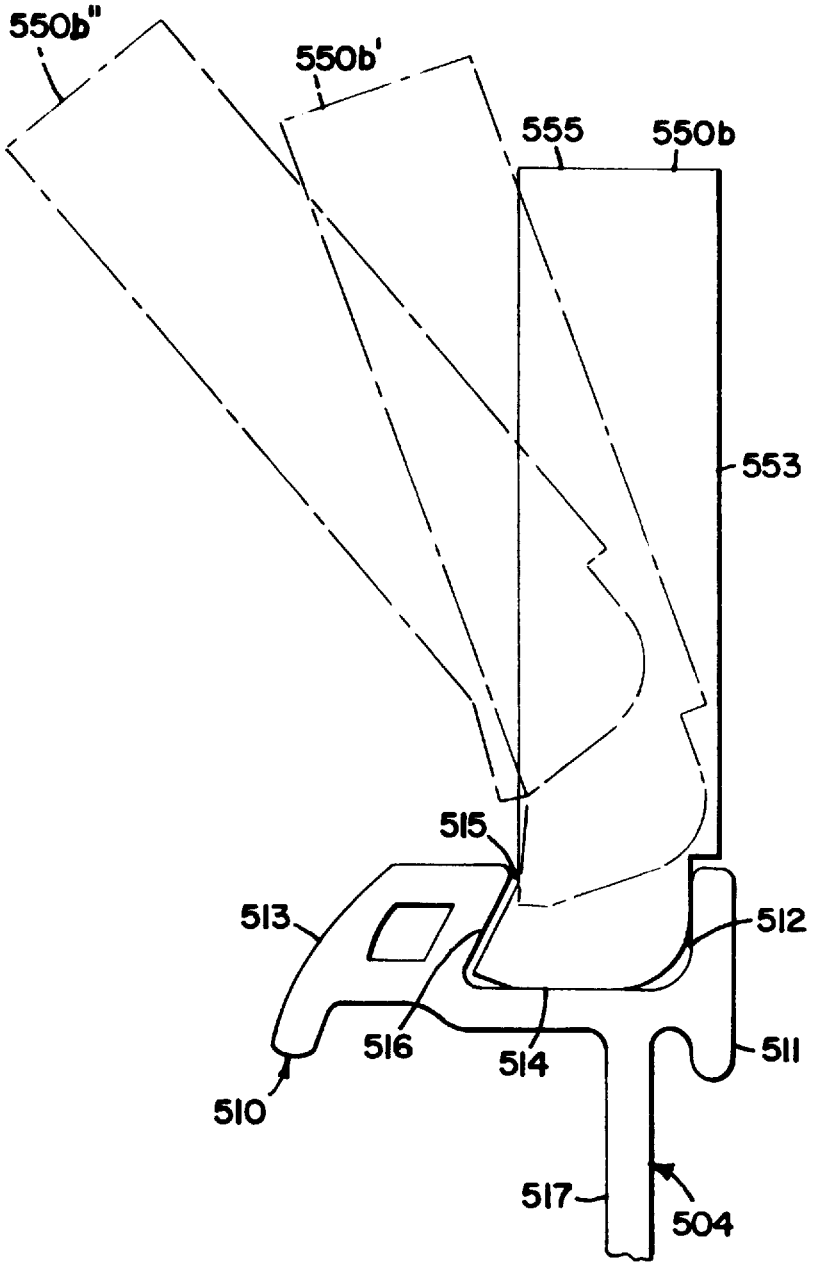
FIG. 5 is a top plan view of the component of FIG. 3 in relation to a component of the window frame of FIG. 1.

A portion of the window frame segment 504 is shown in FIG. 5 and is representative of corresponding portions of the other window frame segments 501–503. The segment 504 includes a main beam 517 which receives and supports a respective liner of a window pocket. One end of the beam 517 terminates in an interior end 510 of the segment 504, which extends generally perpendicular to the beam 517 from a wall engaging foot 511 at one end thereof, to an aesthetically curved surface 513 at an opposite end. A channel is disposed between the foot 511 and the surface 513 and opens towards the interior of the window assembly 500. The channel 515 is bounded by a first, angled sidewall 516, a bottom wall 514 which extends at an acute angle from the first sidewall 516, and a second sidewall 512 which extends approximately perpendicular to the bottom wall 514.

Window Frame Extension

The window frame extension 520 includes two vertical members 550*a* and 550*b* and two horizontal members 650*a* and 650*b* which are connected to the window frame 510, as well as one another. The two vertical members 550*a* and 550*b* are mirror images of one another, and the two horizontal members 650*a* and 650*b* are also mirror images of one another. The window frame extension 520 is connected to the window 510 to provide additional depth and effectively span a rough opening of 2×6 construction.

Figure 3:
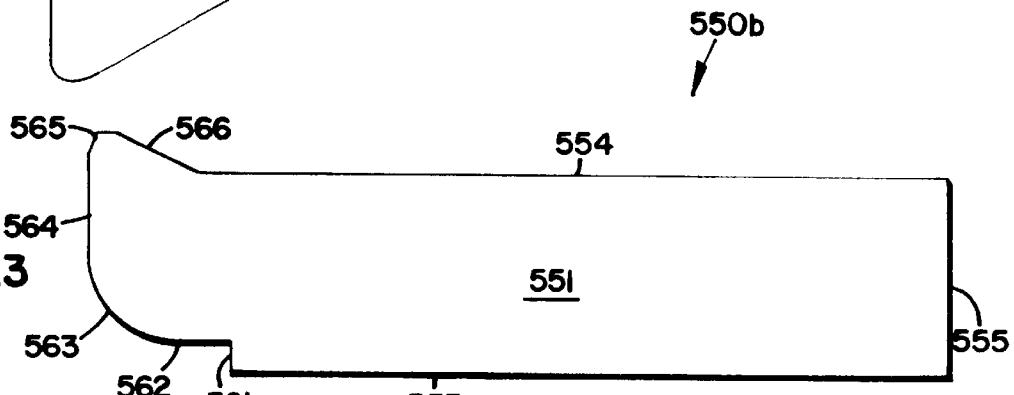
FIG. 3 is a top plan view of one of the components of FIG. 2.

In the preferred embodiment, the members 550*a* and 550*b* are wood boards, but those skilled in the art will recognize that the present invention may be practiced with members made of various materials. Each of the vertical members 550*a* and 550*b* is an elongate board having a continuous profile or uniform cross-section which is shown in FIG. 3. The profile may be said to be generally rectangular with a one-half dovetail 560 at one end thereof. A top surface 551 and a bottom surface 552 cooperate to define a board length therebetween. An outwardly facing surface 553 and an inwardly facing surface 554 cooperate to define a board thickness therebetween. A distal edge 555 and a parallel edge 564 of the one-half dovetail 560 cooperate to define a board depth therebetween. The top surface 551 and the bottom surface 552 define obtuse angles relative to the distal edge 555 for reasons discussed below.

In addition to the parallel edge 564, the one-half dovetail 560 includes an offset edge or surface 561 which extends substantially parallel to the edge 564. The offset edge 561 extends from a frameward end of the outwardly facing surface 553 and cooperates therewith to define a generally square, external corner. A nested surface 562 extends from an opposite end of the offset edge 561 and generally perpendicular thereto. A curved surface 563 extends between and interconnects the nested surface 562 and the parallel edge 564. The curved surface 563 extends in generally arcuate fashion through approximately ninety degrees and cooperates with the nested surface 562 and the parallel edge 564 to provide a continuous and smooth surface.

A first beveled edge or surface 565 extends from an opposite end of the parallel edge 564 at an obtuse angle relative thereto. A second beveled edge or surface 566 extends from an opposite end of the first beveled edge 565 at an acute angle relative thereto. An angled edge 567 extends between and interconnects the second beveled edge 566 and the inwardly facing surface 554. The angled edge 567 extends generally perpendicular to the second beveled edge 566.

Figure 4:
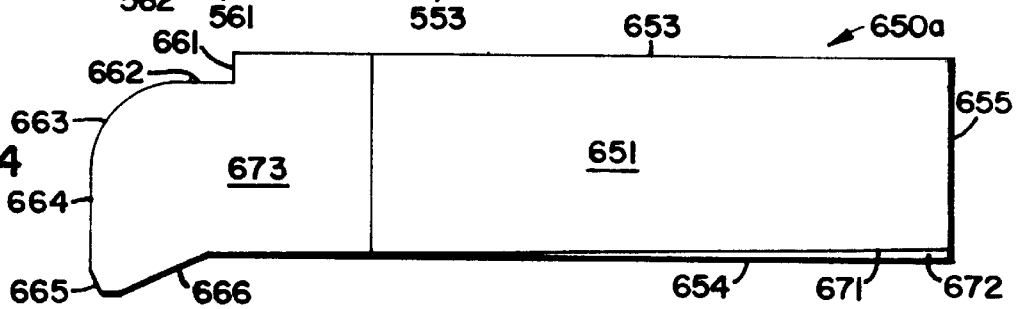
FIG. 4 is an end elevation view of another of the components of FIG. 2.

In the preferred embodiment, the members 650*a* and 650*b* are also wood boards, but again, those skilled in the art will recognize that the present invention may be practiced with members made of various materials. Each of the horizontal members 650*a* and 650*b* is an elongate board having a profile or cross-section which is shown in FIG. 4. The profile is continuous or uniform except for notches formed in each end of each of the members 650*a* and 650*b*. The overall profile is similar to that of the vertical members 550*a* and 550*b* and thus, may also be said to be generally rectangular with a one-half dovetail 660 at one end thereof. A top surface 651 and a bottom surface 652 cooperate to define a board length therebetween. An outwardly facing surface 653 and an inwardly facing surface 654 cooperate to define a board thickness therebetween. A distal edge 655 and a parallel edge 664 of the one-half dovetail 660 cooperate to define a board depth therebetween.

In addition to the parallel edge 664, the one-half dovetail 660 includes an offset edge or surface 661 which extends substantially parallel to the edge 664. The offset edge 661 extends from a frameward end of the outwardly facing surface 653 and cooperates therewith to define a generally square, external corner. A nested surface 662 extends from an opposite end of the offset edge 661 and generally perpendicular thereto. A curved surface 663 extends between and interconnects the nested surface 662 and the parallel edge 664. The curved surface 663 extends in generally arcuate fashion through approximately ninety degrees and cooperates with the nested surface 662 and the parallel edge 664 to provide a continuous and smooth surface.

A first beveled edge or surface 665 extends from an opposite end of the parallel edge 664 at an obtuse angle relative thereto. A second beveled edge or surface 666 extends from an opposite end of the first beveled edge 665 at an acute angle relative thereto. An angled edge 667 extends between and interconnects the second beveled edge 666 and the inwardly facing surface 654. The angled edge 667 extends generally perpendicular to the second beveled edge 666.

A first notch is formed in each end of each of the members 650*a* and 650*b* by cutting into the inwardly facing surface 654. The cut defines a first plane or edge 671 (or 675) which generally intersects the juncture between the surfaces 654 and 667 and which extends generally parallel to a line extending from the juncture or corner defined between the surfaces 666 and 667 to the juncture or corner defined between the surfaces 654 and 655. The cut also defines a second plane or edge 672 (or 676) which extends between the first plane 671 (or 675) and the inwardly facing surface 654 and generally perpendicular to each. Hence, the cut into the inwardly facing surface 654 may be made simply by positioning either of the members 650*a* or 650*b* on a table saw with the inwardly facing surface 654 facing toward the table, and adjusting the height of the saw blade to coincide with the juncture between the surfaces 654 and 667. The width of the edge 671 (or 675), as measured between the second edge 672 (or 676) and the end 651 (or 652), is approximately equal to the board thickness of the vertical member to be secured adjacent thereto.

A second notch is formed in each end of each of the members 650*a* and 650*b* by cutting across the inwardly facing surface 654 and the one-half dovetail 660. The cut defines a plane or edge 673 (or 677) which extends substantially perpendicular relative to the inwardly facing surface 654 and at angles of approximately one hundred and thirty-five degrees relative to each of the surfaces 651 (or 652) and 664. These second notches provide clearance for the vertical members 550*a* and 550*b* to be inserted into their respective frame members and rotated into their intended orientation relative thereto.

Each of the extension members 550*a–b* and 650*a–b* is connected to its respective frame member in similar fashion. An explanation of this manner of interconnection is made with reference to FIG. 5, which shows extension member 550*b* relative to its respective frame member 504. The extension member 550*b* is positioned relative to the frame member 504 in such a manner that the angled or leading edge 567 is proximate the channel 515 and generally at a mirrored angle relative to the first sidewall 516 thereof. In other words, in this starting position designated at 550*b*", the angled edge 567 and the first sidewall 516 define approximately equal and opposite angles relative to a line drawn across the mount of the channel 515.

The dovetail segment 560 of the extension member 550*b* is then moved into the channel 515 to arrive at an intermediate position, which is designated at 560', wherein the curved or trailing edge 562 approaches the mouth of the channel 515 and the second sidewall 512. The dovetail segment 560 of the extension member 550*b* is then further inserted into and rotated within the channel 515 to arrive at a final position, which is shown in solid lines, wherein the angled edge 567 is parallel to the first sidewall 516, and the parallel edge 564 is parallel to the bottom sidewall 514, and the nested edge 562 is parallel to the second sidewall 512. In this final position relative to the frame segment 504, the extension member 550*b* cannot be pulled straight out from the channel 515 (in a direction parallel to the main beam 517 of the frame segment 504.

Figure 6:
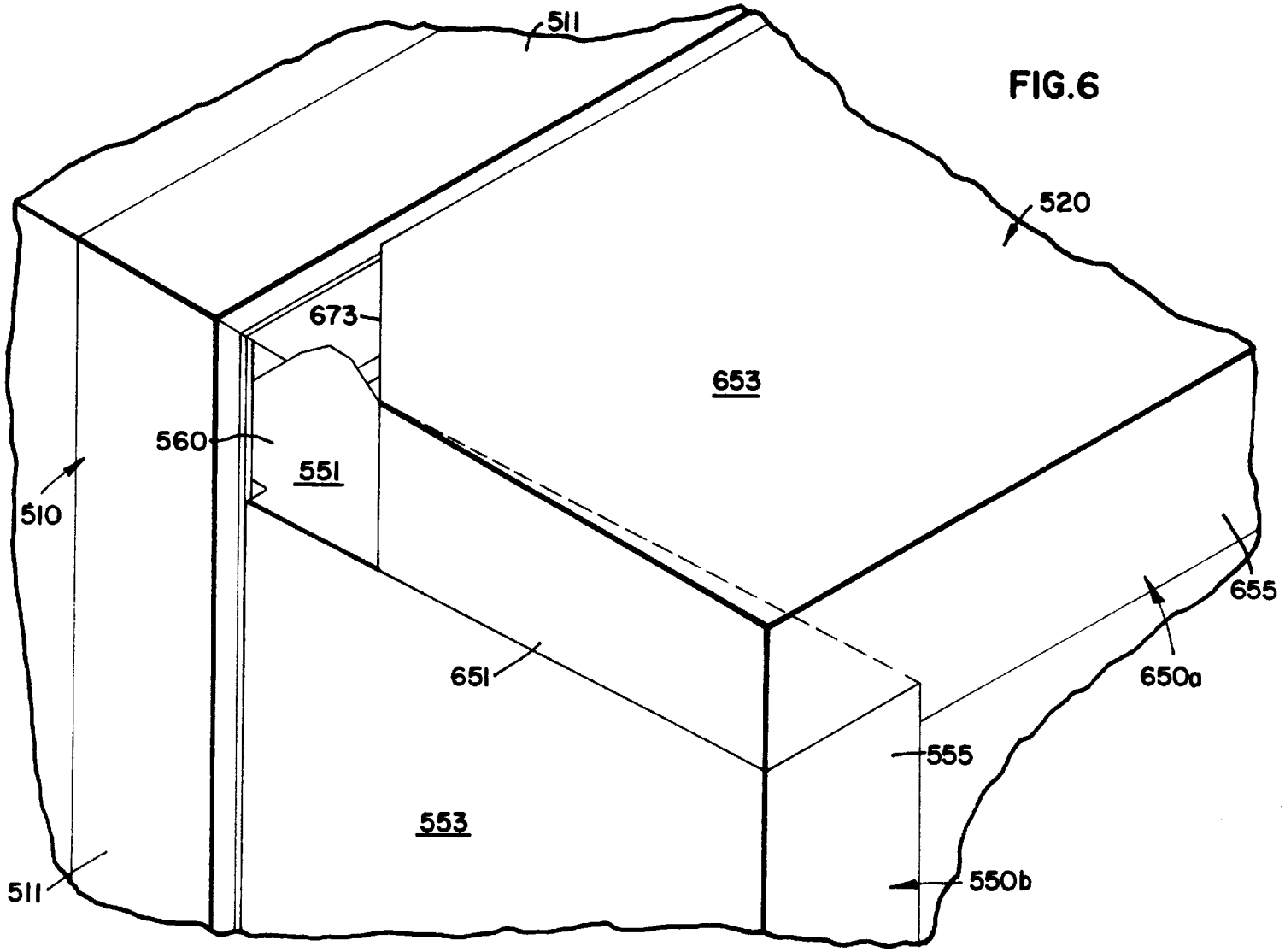
FIG. 6 is an isometric view of a corner of the window and window frame jamb extension of FIG. 1.
Figure 7:
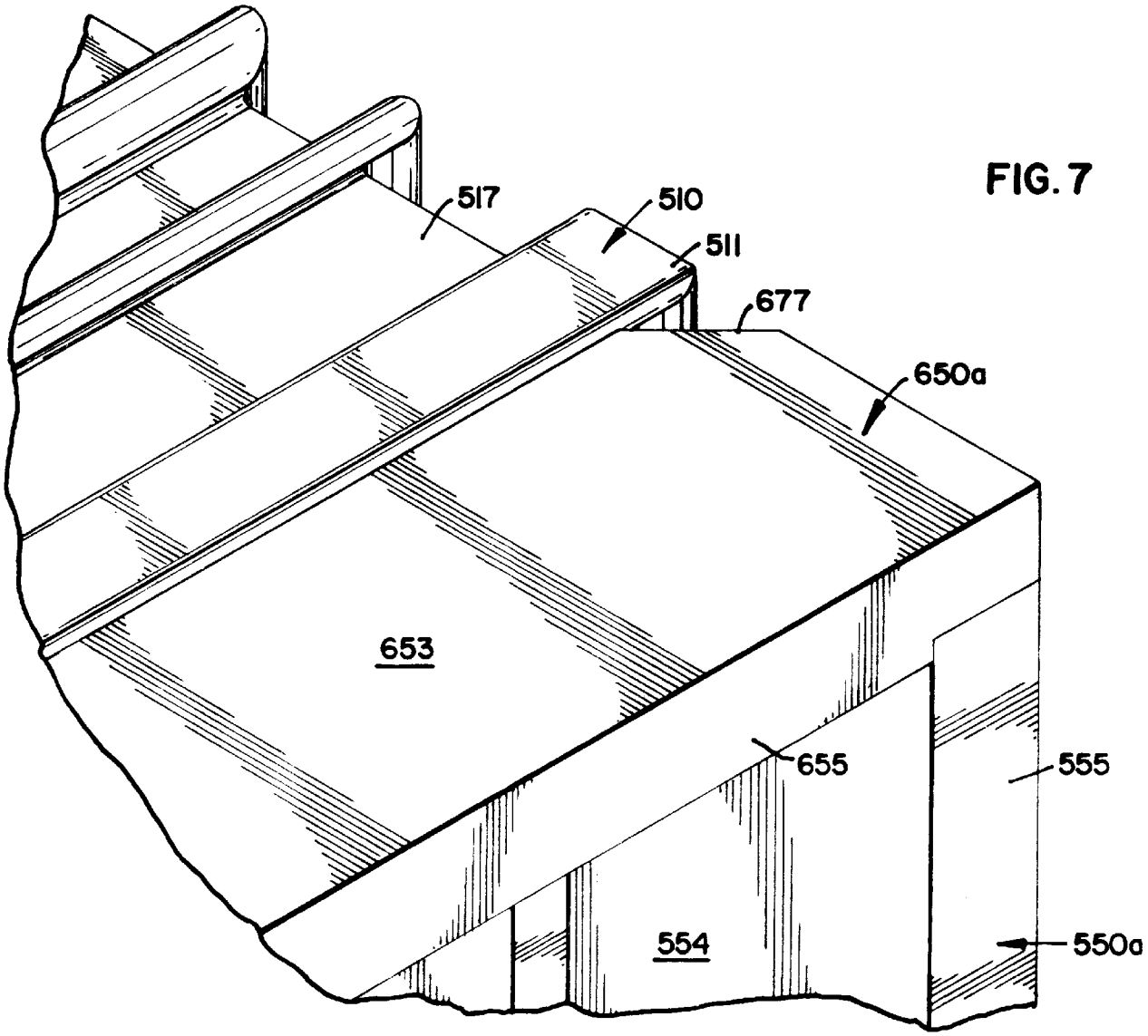
FIG. 7 is an isometric view of another corner of the window and window frame jamb extension of FIG. 1.

In the preferred embodiment, the horizontal members 650*a–b* are first connected to their respective frame segments 501 and 502. The vertical members 550*a–b* are subsequently connected to their respective frame segments 503 and 504. The resilience of the frame segments 501 and 502 allows the horizontal (or top and bottom) extension members 650*a–b* to rotate slightly away from one another to receive the vertical extension members 550*a–b* therebetween. The notches across the corners of the horizontal members 650*a–b* provide clearance for the dovetail segments 560 of the vertical extension members 550*a–b*. As the vertical extension members 550*a–b* are inserted between the horizontal members 650*a–b* and rotated into position relative to their respective frame segments 503–504, the opposite ends 551 and 552 thereof snap into the notches in the inwardly facing surfaces 654 and behind the edges 672 and 676, respectively, of the horizontal members 650*a–b*. The resilience of the frame segments 501 and 502 then causes the horizontal (or top and bottom) extension members 650*a–b* to rotate back toward one another to retain the vertical extension members 550*a–b* therebetween (without the need for any additional fasteners). Two of the resulting corners are shown in FIGS. 6 and 7.

Figure 8:
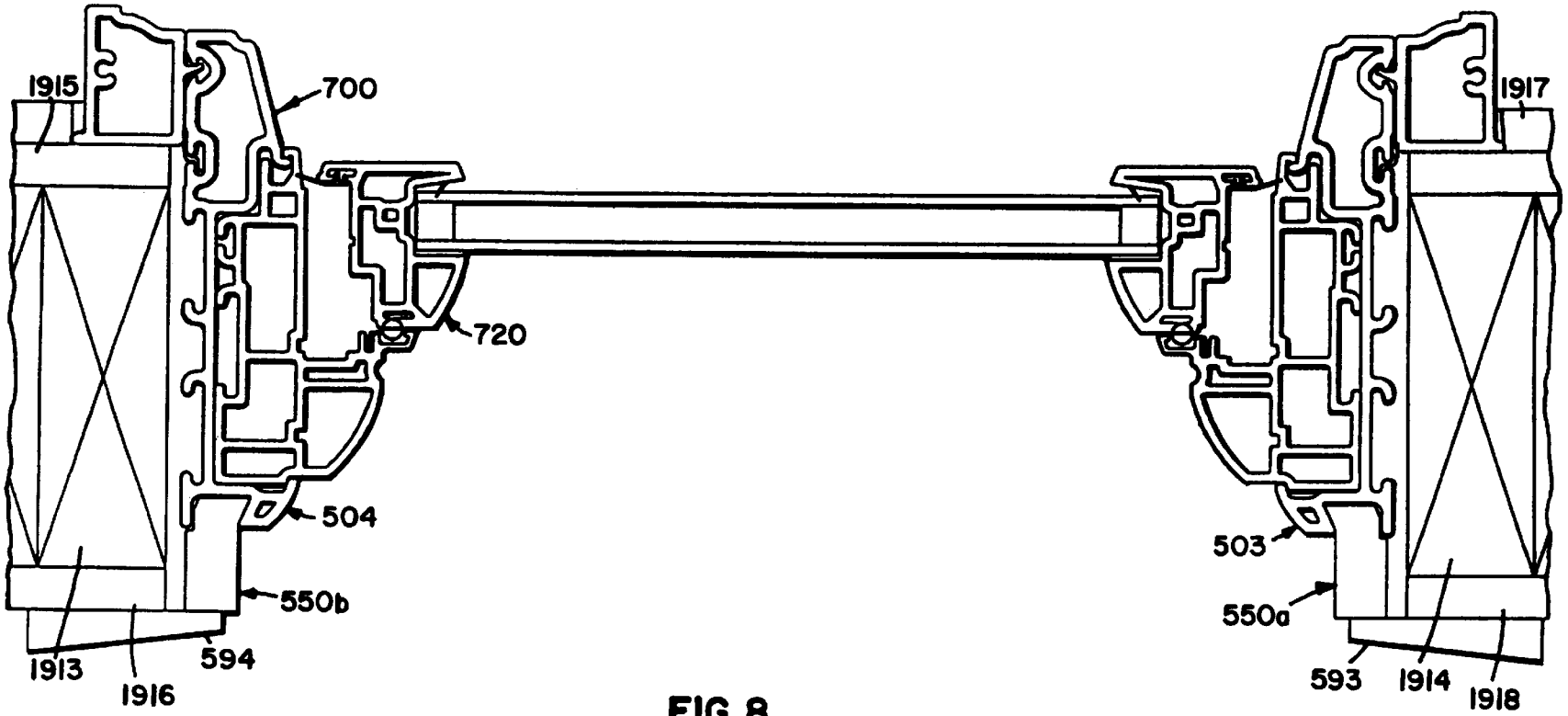
FIG. 8 is a sectioned side view of a casement window assembly constructed according to the principles of the present invention for window in/window out replacement of an existing casement window assembly and shown secured within a rough opening.

An application of the present invention is shown in FIG. 8 with reference to a top view of a casement window 700. The casement window 700 includes a pocket portion 720 which has been fitted with frame segments 501–504, which in turn, have been fitted with extension members 550*a–b* and 650*a–b*. The framed casement window 700 is secured within a rough opening bordered by 2×6 studs (2 of which are designated as 1913 and 1914) with a wall covered by inner and outer sheets 1915-1918. The extension members 550*a–b* (and 650*a–b*) cooperate with the frame segments 503–504 (and 501–502) to span the depth of the opening. Trim pieces 593 and 594 finish off the interior of the installed unit.

Alternative Embodiment

An alternative embodiment of the present invention is discussed with reference to FIGS. 9–11. In one application for this alternative embodiment, a new construction, double hung window assembly 800 includes extension jamb clips 841–844 secured about an inwardmost portion of respective frame members (including 201 and 203), as well as outer frame members or moulding (including 881 and 883) secured about an outwardmost portion of respective frame members (including 201 and 204), respectively. Extending from the outer frame members 881–884 are nailing flanges (including 891 and 893), which are shown and described in U.S. Pat. No. 4,958,469 to Plummer. To the extent that it facilitates understanding of the present invention, this patent application is incorporated herein by reference to same.

When the window assembly 800 is placed within the rough opening 802, the frame members, extension jamb clips, and outer frame members are adjacent respective jambs (including 811 and 813). The nailing flanges are arranged to extend outward from the outer frame members and to lie substantially flush against the first exterior sheet 815. Nails or other fasteners are then used to secure the nailing flanges to the first exterior sheet, either before or after a second exterior sheet 816, such as wood siding, is placed over the nailing flanges and the first exterior sheet. The nailing flanges span and thereby seal any gap between the window frame members and the jambs about the rough opening. A bead of caulk is then disposed along the juncture 817 between the outer frame members and the second exterior sheet to provide an additional seal. The window assembly 800 is also secured within the rough opening by screws through the side jamb liners and respective frame members, and into the side jambs 812 and 814, respectively, and screws 821 through the head jamb liner 370 and the frame member 201, and into the head jamb 811*a*.

Recognizing that the three and one-half inch deep window assembly 800 does not fully occupy the 2×6 rough opening, extension jambs 861–864 are provided to span the unoccupied depth of the rough opening. Each of the extension jambs 861–864 is wood and has the cross-sectional shape or profile of that shown in FIG. 10 for the sill extension jamb 861. The profile includes a relatively long segment 865 and a relatively short segment 866 that are integrally joined at an obtuse angle relative to one another to define an elbow 867. An opposite, distal end 868 of the longer segment 865 is square relative to the sides of the longer segment 865, as is an opposite, distal end 869 of the shorter segment 866. The resulting configuration may be said to provide a half dovetail arrangement having a leading corner 860 that is chamfered in the manner shown.

Figure 10:
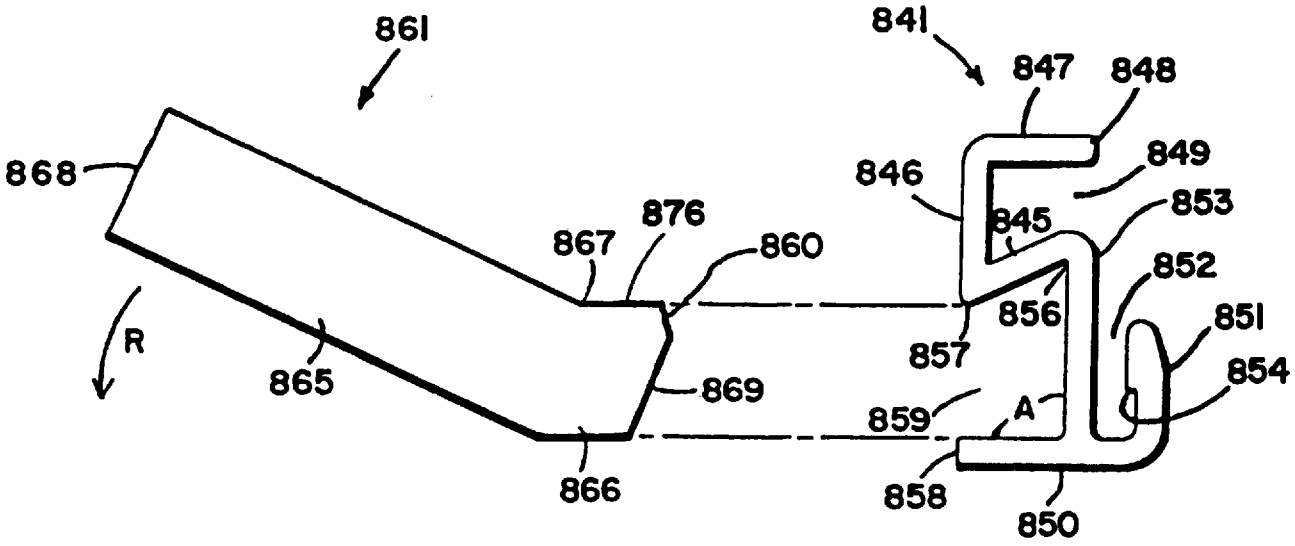
FIG. 10 is a profile or sectioned side view of an alternative embodiment extension jamb and extension jamb clip constructed according to the principles of the present invention and shown in relation to one another.
Figure 11:
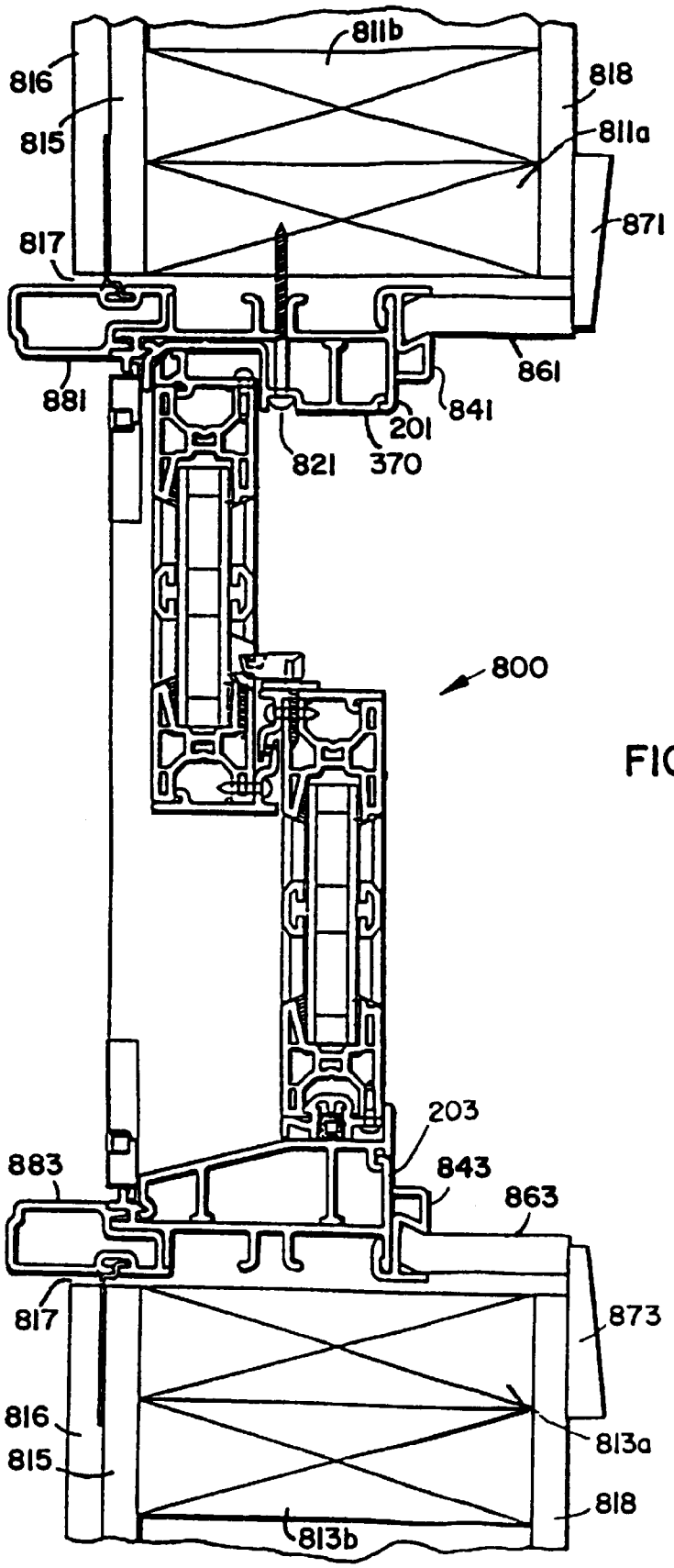
FIG. 11 is a sectioned side view of a double hung window assembly constructed according to the principles of the present invention for window in/window out replacement of an existing double hung window assembly and shown secured within a rough opening.

Each of the extension jamb clips 841–844 has the cross-sectional shape or profile of that shown in FIG. 10 for the clip 841. The profile includes a substantially S-shaped portion extending from an upper distal end 848, laterally across an upper horizontal member 847, downward along an upper vertical member 846, substantially laterally across an intermediate member 845, downward along a lower vertical member 853, and laterally across a lower horizontal member 850, to a lower distal end 858. The upper horizontal member 847, the upper vertical member 846, and the intermediate member 845 define a channel or groove 849 therebetween, having a substantially trapezoidal profile and opening in a direction opposite the extension jamb 861. The intermediate member 845, the lower vertical member 853, and the lower horizontal member 850 define a channel or groove 859 therebetween, having a substantially trapezoidal profile and opening in a direction toward the extension jamb 861. The lower horizontal member 850 and the lower vertical member 853 cooperate to define an angle A therebetween. The angle-A is slightly less than ninety degrees, eight-eight degrees to be exact, so as to provide a resilient clamping force against an extension jamb inserted therebetween. The chamfered corner 860 helps to wedge the end 869 between corner 857 and the end 858 of the wall 850.

The lower horizontal member 850 extends from the distal end 858 beyond the lower vertical member 853 and integrally joins an additional vertical member 851 that may be said to be barbed. The barbed vertical member 851 cooperates with the lower vertical member 853 and a portion of the lower horizontal member 850 to define a channel or groove 852, which opens in a direction away from the lower horizontal member 850. A shoulder 854 projects from the barbed vertical member 851 into the groove 852. The groove 852 receives the barbed end on the window frame 201 and the respective shoulders on the frame end and the barbed vertical member 852 interengage to resist withdrawal of the frame end from the groove 852. In this manner, the jamb extension clips 841–844 are secured to the window frame members, respectively, to arrive at the arrangement 840 shown in FIG. 23.

The width of each channel 859 is substantially similar to the width of the shorter segment 866 on each of the extension jambs 861–864. Beginning with each of the side jamb extensions 862 and 864, each extension is oriented relative to a respective clip as shown in FIG. 10. The angled side or leading edge 876 is positioned proximate the corner 857, and the shorter segment 866 is inserted into the channel 859 until the leading corner 860 contacts the lower vertical member 853. Each of the side extension jambs 862 and 864 is then rotated relative to a respective clip 842 and 844 in the manner indicated by the arrow R in FIG. 10. The corner 860 travels into a recessed area formed by the acutely angled corner 856 between the intermediate member 845 and the lower vertical member 853; the end 869 moves into a substantially flush or aligned orientation relative to the lower vertical member 853; and a portion of the longer member 865 moves into a substantially flush or aligned orientation relative to the lower horizontal member 850. The same procedure is then followed for the head jamb extension 861 and the sill jamb extension 863.

Figure 9:
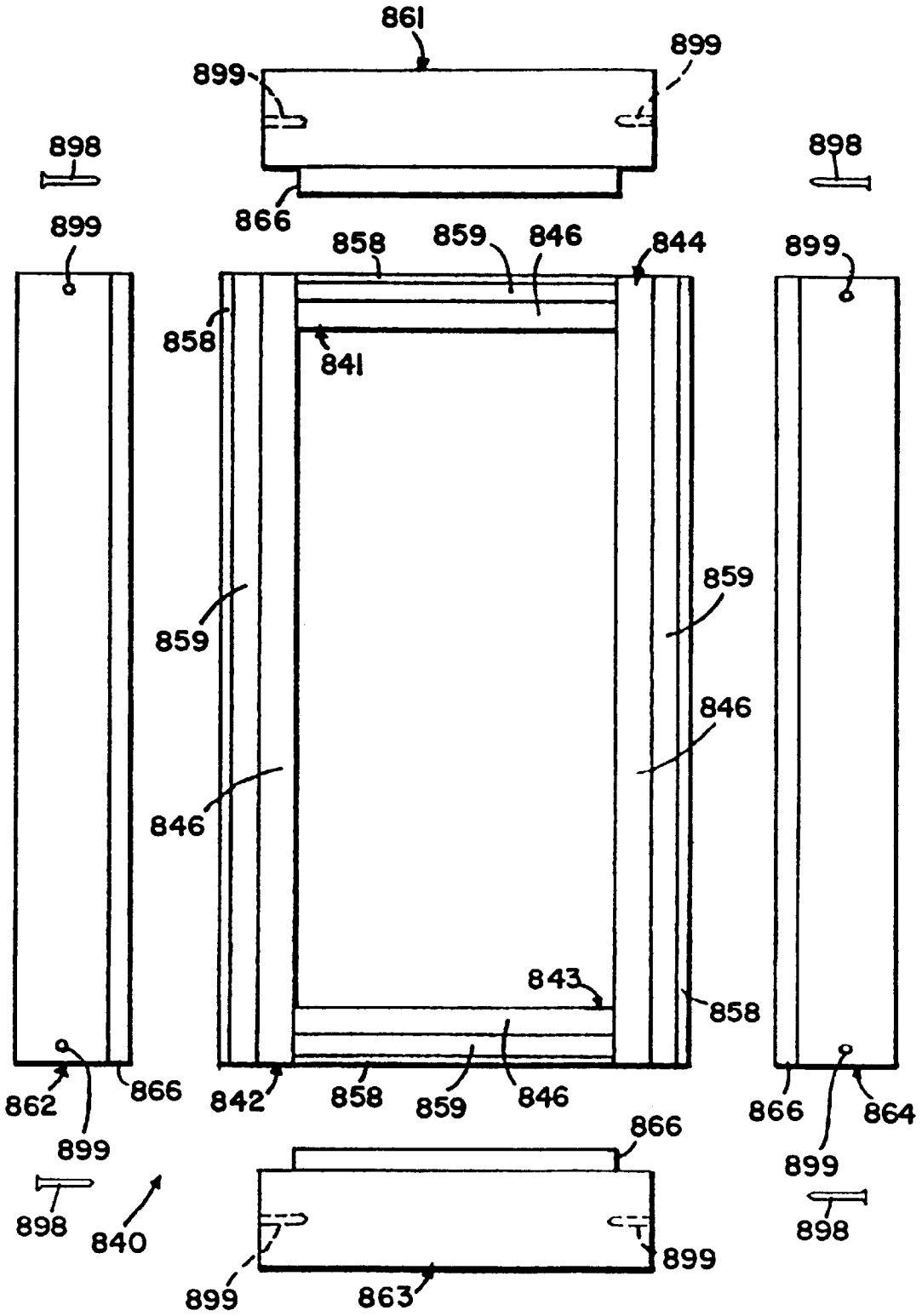
FIG. 9 is a front view of a partially assembled, alternative embodiment extension jamb assembly constructed according to the principles of the present invention.

As shown in FIG. 9, the side jamb clips 842 and 844 and the side jamb extensions 862 and 864 extend lengthwise substantially the entire length of the window assembly 800. On the other hand, the head jamb clip 841 and the sill jamb clip 843, and the head jamb extension 861 and the sill jamb extension 863 extend lengthwise less than the entire width of the window assembly 800, because they are bordered at opposite ends by the side jamb clips 842 and 844 and the side jamb extensions 862 and 864, respectively. The shorter segments 866 of the head and sill jamb extensions 861 and 863 extend lengthwise the same distance as the head and sill jamb clips 841 and 843, respectively. The longer segments 865 of the head and sill jamb extensions 861 and 863 extend lengthwise beyond the shorter segments 866 to span the upper vertical members 846 of the side jamb clips 842 and 844 and abut the side jamb extensions 862 and 864. Once the head and sill jamb extensions 861 and 863 are inserted into their respective clips 841 and 843 and rotated between the opposing side jamb extensions 862 and 864, the four jamb extensions are secured in place by screws 898, which extend through holes 899 in the side jamb extensions and into the head and sill jamb extensions. This half dovetail extension jamb arrangement 840 requires only four screws to assemble and eliminates the need or use of nails or other fasteners extending from the extension jambs into the window frame or associated structure.

Once the extension jambs are secured in place, trim members (including 871 and 873) are secured between the square ends 868 of the respective extension jambs (including 861 and 863) and the interior sheet of material 817, either before or after the interior sheet of material 817 is coated with paint or some other finish.

Figure 12:
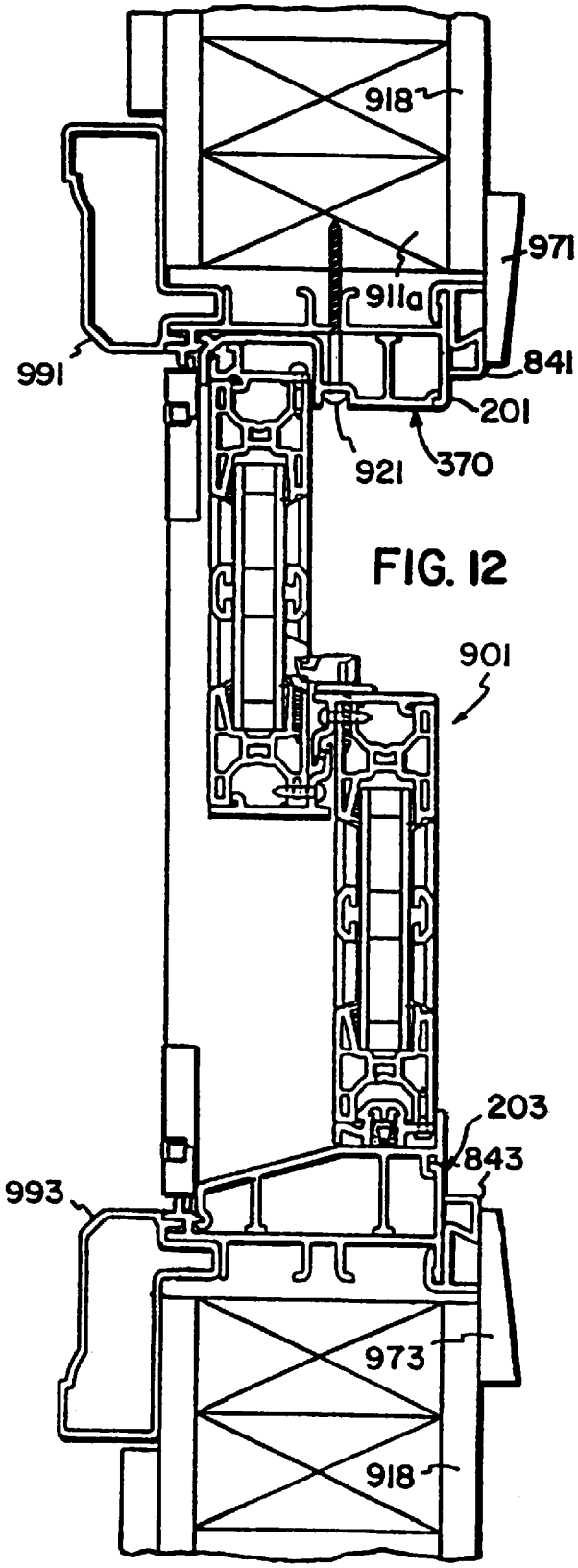
FIG. 12 is a sectioned side view of a double hung window assembly constructed according to the principles of the present invention for new construction and shown secured within a rough opening.

A second application for the alternative embodiment is discussed with reference to FIG. 12, wherein removal of an existing window assembly, including the frame and moulding, leaves a rough opening bounded by structural members, in this case "2×4" boards approximately three and one-half inches wide and one and one-half inches thick.

A suitably sized replacement window 901 is positioned within the rough opening and secured in place by means of screws 921 driven through the head liner 370 and upper frame member 201 and into the head jamb 911*a*, and screws driven through the side jamb liners and side frame members and into the respective side jambs. Interior trim members (including 971 and 973) are secured between the interior sheet of material 917 and the upper vertical members 846 on respective jamb clips (including 841 and 843). Exterior trim members (including 991 and 993) are secured to the exterior sheet of material 916. A bead of caulk is disposed along a corner defined between each of the trim members and the exterior sheet of material 916.

The present invention is described with reference to particular embodiments and applications. However, those skilled in the art will recognize additional embodiments and applications of the present invention. Accordingly, the present invention is to be limited only to the extent of the following claims:

We claim:

1. A rectangular window assembly, comprising:

a first channel extending along a first horizontal frame member;

a second channel extending along a second horizontal frame member;

a third channel extending along a first vertical frame member and between distal ends and associated structure of said first channel and said second channel;

a fourth channel extending along a second vertical frame member and between opposite distal ends and associated structure of said first channel and said second channel;

a first extension member;

a second extension member;

a third extension member;

a fourth extension member, wherein each said extension member has a profile that includes a first segment configured to rotate into engagement with a respective channel, and a second segment configured to extend substantially perpendicularly away from a plane defined by said frame members, and on said first extension member and said second extension member, said second segment is approximately equal in length to said first frame member and said second frame member, respectively, and on said third extension member and said fourth extension member, said second segment is less than equal in length to said third frame member and said fourth frame member, and is approximately equal in length to a distance defined between said first extension member and said second extension member, and distal ends of said second segment abut said first extension member and said second extension member proximate corresponding ends thereof; and a securing means for securing said third extension member and said fourth extension member between said first extension member and said second extension member in such a manner that each said extension member is secured against rotation of out engagement with a respective channel.

2. A rectangular window assembly according to claim 1, wherein said securing means includes at least one screw through each of said first extension member and said second extension member and into each of said third extension member and said fourth extension member.

3. A rectangular window assembly according to claim 1, wherein each said channel has a similar, half-dovetail profile, and each said first segment extends at an obtuse angle from parallel side edges on a respective second segment.

4. A rectangular window assembly according to claim 1, wherein said securing means includes notches formed in said first extension member and said second extension member to receive said distal ends of said third extension member and said fourth extension member.

5. A rectangular window assembly according to claim 4, wherein said distal ends of said third extension member and said fourth extension are angled such that a distal edge of each said first segment is shorter than an opposite, distal edge of each said second segment, and said notches are relatively deep at a distal edge of each said second segment and gradually decrease to no depth where each said second segment meets a respective first segment, and when corresponding distal edges engage corresponding notches, said third extension member and said fourth extension member extend perpendicularly to said first extension member and said second extension member.

6. A rectangular window assembly according to claim 1, wherein a corner is removed from each distal end of said first extension member and said second extension member in such a manner that each said second segment is longer than each said first segment, and clearance is provided for introduction of said first segment of each of said third extension member and said fourth extension member.

7. An assembly, comprising:

an extension member;

a frame; and a means on said frame for receiving said extension member when said extension member is in a first orientation relative to said means, and for retaining said extension member when said extension member is in a second orientation relative to said means, wherein in said second orientation, said extension member extends in a direction generally perpendicular to a plane defined by said frame, and for providing a substantially flat surface against which an alternative trim piece to said extension member may be secured to extend in a direction generally parallel to said plane defined by said frame.

8. An assembly according to claim 7, wherein said receiving means is an attachment that clips onto said frame.

9. An assembly according to claim 7, wherein said receiving means provides a channel that has a substantially half-dovetail cross-section and opens in said direction generally perpendicular to said plane defined by said frame.

10. An assembly, comprising:

an extension member;

a frame; and a channel on said frame, said channel having a substantially half-dovetail cross-section bounded by a first sidewall, a second sidewall, and a bottom wall extending therebetween, wherein said first sidewall and said bottom wall cooperate to define an acute angle therebetween, and said second sidewall and said bottom wall extend substantially perpendicular relative to one another, and said extension member has a cross-section bounded by a top edge and a bottom edge that extend substantially parallel to one another, and first and second side edges that extend substantially parallel to one another and substantially perpendicular away from opposite ends of said top edge to respective first and second angled edges, which extend substantially parallel to one another from junctures with respective side edges to opposite ends of said bottom edge, and said first angled edge cooperates with said bottom edge to define said acute angle therebetween, and said channel receives said extension member when said extension member is in a first orientation relative to said channel, and said channel retains said extension member when said extension member is in a second orientation relative to said channel, and in said second orientation, said extension member extends in a direction generally perpendicular to a plane defined by said frame.

11. An assembly according to claim 10, wherein said second sidewall and said bottom wall cooperate to define an angle of eighty-eight degrees therebetween, and distal ends of said first sidewall and second sidewall define a channel opening therebetween, and said channel opening is slightly smaller than a mean thickness of said extension member, whereby said distal ends pinch said extension member when said extension member is disposed therebetween.

12. An assembly according to claim 11, wherein a corner defined between said first angled edge and said bottom edge is chamfered to facilitate insertion of said extension member into said channel.

13. An assembly according to claim 10, further comprising a first securing means for securing said receiving means relative to said frame in such a manner that said channel opens away from said frame in said direction generally perpendicular to said plane defined by said frame.

14. A method of extending a frame arrangement in a direction generally perpendicular to a plane defined by the frame arrangement, comprising the steps of:

providing a first member with a channel having a substantially half-dovetail cross-section that is bounded by a first sidewall, a second sidewall, and a bottom wall extending therebetween, and arranged so that the first sidewall and the bottom wall cooperate to define an acute angle therebetween, and the second side wall and the bottom wall extend substantially perpendicular relative to one another, wherein the first member is oriented relative to the frame arrangement in such a manner that the channel extends in a direction generally parallel to a segment of the frame arrangement to which the first member is secured, and the channel opens in the direction generally perpendicular to the plane defined by the frame arrangement;

providing a second member having a cross-section that is bounded by a leading edge and a trailing edge having portions that extend parallel to one another on a first segment thereof, and further bounded by first and second side edges that extend parallel to one another on a second segment thereof, wherein the side edges extend in the direction generally perpendicular to the plane defined by the frame arrangement when the leading edge is parallel to the first sidewall of the first member;

arranging the second member relative to the first member so that the leading edge is proximate the channel and generally at a mirrored angle relative to the first sidewall;

inserting the second member into the first member until the leading edge nears the bottom wall; and rotating the second member relative to the first member while continuing to insert the second member into the first member until the leading edge is parallel to the first sidewall, and the trailing edge is parallel to the second sidewall.

15. A method according to claim 14, wherein the frame arrangement includes a plurality of segments joined together, and the method is repeated for each of the plurality of segments, and adjoining second members are secured relative to one another by means of fasteners.

16. A method according to claim 14, wherein the frame includes four frame segments arranged end to end and perpendicular to one another to form a rectangle, and a first member is associate with each of the four frame segments, and a second member is provided for each of the four frame segments, and the second members for a first pair of opposing frame segments are substantially as long as the first pair of opposing frame segments, and the second members for a second pair of opposing frame segments are shorter than the second pair of opposing frame segments, and the method of claim 14 is performed first in connection with the first pair of opposing frame segments, and subsequently in connection with the second pair of opposing frame segments.

17. A method according to claim 16, wherein the second members extend between opposite ends in directions generally parallel to respective frame segments to which the second members are secured, and when the second members for the second pair of opposing frame segments are rotated into engagement with their respective frame segments, their respective opposite ends are disposed between inwardly directed side edges on the second members secured to the first pair of opposing frame segments.

18. A method according to claim 17, further comprising the step of driving fasteners through the side edges and into the respective opposite ends.

19. A method according to claim 17, further comprising the step of forming notches in the side edges to receive and retain the respective opposite ends.

* * * * *